US010415177B2

(12) United States Patent
Xu et al.

(10) Patent No.: US 10,415,177 B2
(45) Date of Patent: Sep. 17, 2019

(54) CONTROL METHOD FOR CLOTHES DRYER, AND CLOTHES DRYER

(71) Applicant: QINGDAO HAIER WASHING MACHINE CO., LTD., Laoshan, Qingdao, Shandong (CN)

(72) Inventors: Sheng Xu, Shandong (CN); Huacheng Song, Shandong (CN); Shujun Tian, Shandong (CN); Shiqiang Shan, Shandong (CN)

(73) Assignee: QINGDAO HAIER WASHING MACHINE CO., LTD., Qingdao (CN)

( * ) Notice: Subject to any disclaimer, the term of this patent is extended or adjusted under 35 U.S.C. 154(b) by 165 days.

(21) Appl. No.: 15/541,402

(22) PCT Filed: Jul. 3, 2015

(86) PCT No.: PCT/CN2015/083314
§ 371 (c)(1),
(2) Date: Jul. 3, 2017

(87) PCT Pub. No.: WO2016/112661
PCT Pub. Date: Jul. 21, 2016

(65) Prior Publication Data

US 2017/0356122 A1 Dec. 14, 2017

(30) Foreign Application Priority Data

Jan. 12, 2015 (CN) ..... 2015 1 0013812

(51) Int. Cl.
*D06F 58/28* (2006.01)
*D06F 58/24* (2006.01)
(Continued)

(52) U.S. Cl.
CPC ..... *D06F 58/28* (2013.01); *D06F 58/206* (2013.01); *D06F 58/24* (2013.01); *D06F 58/26* (2013.01);
(Continued)

(58) Field of Classification Search
CPC ..... D06F 58/28; D06F 58/206; D06F 58/24; D06F 58/26; D06F 58/02; D06F 2058/2858; D06F 2058/287; D06F 2058/289
(Continued)

(56) References Cited

U.S. PATENT DOCUMENTS 4,621,438 A * 11/1986 Lanciaux ..... D06F 58/04 34/242
5,343,632 A * 9/1994 Dinh ..... F26B 21/086 34/507
(Continued)

FOREIGN PATENT DOCUMENTS

CN 1766212 A 5/2006
CN 1766213 A 5/2006
(Continued)

OTHER PUBLICATIONS

Extended European Search Report dated Jan. 2, 2018, issued by the European Patent Office in corresponding European Application No. 15877576.7. (9 pages).
(Continued)

*Primary Examiner* — Stephen M Gravini
(74) *Attorney, Agent, or Firm* — Buchanan Ingersoll & Rooney PC

(57) ABSTRACT

The heat pump system and the electrical heating system of a clothes dryer are controlled to work cooperatively, thus allowing the clothes dryer to at least comprise a fast mode in which the electrical heating pipe of the heating system is
(Continued)

turned on after the compressor of the heat pump system is turned on and operated stably. Air about to enter the clothes drying drum is controlled to be firstly heated by the condenser of the heat pump system and further heated by the electrical heating pipe, and then to enter the clothes drying drum, and the load of the heat pump system is reduced in an auxiliary condensing manner, when the load of the heat pump system is close to the maximum load. Therefore, simultaneous working of the electrical heating system and the heat pump system is ensured, and the clothes drying speed is improved.

20 Claims, 3 Drawing Sheets

(51) Int. Cl.
*D06F 58/20* (2006.01)
*D06F 58/26* (2006.01)
*D06F 58/02* (2006.01)

(52) U.S. Cl.
CPC ..... *D06F 58/02* (2013.01); *D06F 2058/287* (2013.01); *D06F 2058/289* (2013.01); *D06F 2058/2858* (2013.01)

(58) Field of Classification Search
USPC ..... 34/471
See application file for complete search history.

(56) References Cited

U.S. PATENT DOCUMENTS

| | | | | |
|---|---|---|---|---|
| 7,191,543 | B2 * | 3/2007 | Yakumaru | D06F 28/206 34/77 |
| 8,393,172 | B2 * | 3/2013 | Sato | D06F 58/206 34/201 |
| 9,097,462 | B2 * | 8/2015 | Lorenc | D06F 58/206 |
| 9,249,538 | B2 * | 2/2016 | Bison | D06F 58/24 |
| 9,359,714 | B2 * | 6/2016 | Contarini | D06F 58/206 |
| 9,422,662 | B2 * | 8/2016 | Caldeira | D06F 58/206 |
| 9,670,612 | B2 * | 6/2017 | Lee | D06F 58/206 |
| 9,677,218 | B2 * | 6/2017 | Ros | D06F 5/28 |
| 9,803,313 | B2 * | 10/2017 | Ryoo | D06F 58/206 |
| 9,863,086 | B2 * | 1/2018 | Zhu | D06F 39/04 |
| 10,087,569 | B2 * | 10/2018 | Bocchino | D06F 58/22 |
| 10,161,665 | B2 * | 12/2018 | Wu | F25D 11/025 |
| 2014/0165416 | A1 * | 6/2014 | Pillot | D06F 58/04 34/82 |

FOREIGN PATENT DOCUMENTS

| | | | | |
|---|---|---|---|---|
| CN | 101560724 | A | 10/2009 | |
| CN | 103850110 | A | 6/2014 | |
| CN | 104420144 | A | 3/2015 | |
| EP | 2 612 966 | A1 | 7/2013 | |
| EP | 2612964 | A1 | 7/2013 | |
| EP | 2789728 | B1 * | 6/2017 | D06F 58/28 |
| WO | 2012/134148 | A2 | 10/2012 | |
| WO | WO-2014166848 | A1 * | 10/2014 | D06F 58/28 |

OTHER PUBLICATIONS

International Search Report (PCT/ISA/210) dated Oct. 15, 2015, by the Chinese Patent Office as the International Searching Authority for International Application No. PCT/CN2015/083314.

Wrriten Opinion (PCT/ISA/237) dated Oct. 15, 2015, by the Chinese Patent Office as the International Searching Authority for International Application No. PCT/CN2015/083314.

* cited by examiner

CONTROL METHOD FOR CLOTHES DRYER, AND CLOTHES DRYER

TECHNICAL FIELD

The present disclosure relates to the field of clothes dryers, in particular to a control method for a clothes dryer and the clothes dryer.

BACKGROUND

An existing heat pump type clothes drying device is provided with an air circulation channel as follows: heating air heated by a condenser in a heat pump circulation system is sent into a drying chamber filled with clothes, wet air capturing moisture from the clothes is sent back to an evaporator for dehumidification, and dehumidified air is heated by the condenser once again and then sent into the drying chamber.

In order to improve the clothes drying speed, electrical heating pipes are arranged on some heat pump clothes dryers for auxiliary heating; with the combination of the electrical heating pipe and the heat pump system, the temperature rising time of the clothes dryer is reduced, and the drying time is reduced. However, the reduced time is limited within a time range only from the time when a compressor is just turned on for drying until the time when the load of the heat pump system reaches the maximum load (such as the condensing temperature of the compressor reaches 70° C. or the exhaust air temperature of the compressor reaches 105° C.). The reason is that the electrical heating pipe has to stop heating to reduce the load of the heat pump system, when the load of the heat pump system reaches the highest value. After the electrical heating pipe stops heating, the drying speed of the dryer is the same as that of the mode which does not use the electrical heating pipe. If a variable-frequency compressor is used, although the load of the heat pump system can be reduced by reducing the operating frequency of the compressor by making use of frequency regulation of the compressor, a vapour condensing speed is reduced due to reduction of the operating frequency of the compressor, and the drying speed is also affected. In a word, the drying time is not reduced too much by merely adding the electrical heating pipe, when a refrigerating system is not improved.

Therefore, the present disclosure is provided.

The object of the present disclosure is to overcome deficiencies of the prior art, and provides a control method for a clothes dryer and the clothes dryer. The clothes drying speed is improved and the clothes drying time is reduced in a fast mode.

In order to achieve the purpose, the present disclosure adopts the technical scheme as follows; a control method for a clothes dryer comprising a clothes drying drum, a heat pump system and an electrical heating system, wherein the heat pump system comprises a compressor, a condenser, an evaporator and a throttling device, and the electrical heating system is an electrical heating pipe. Characterized by comprising controlling the heat pump system and the electrical heating system to work cooperatively; thus allowing the clothes dryer to at least comprise a fast mode in which the electrical heating pipe is turned on after the compressor is turned on and operated stably; air about to enter the clothes drying drum is controlled to be firstly heated by the condenser of the heat pump system and further heated by the electrical heating pipe, and then to enter the clothes drying drum; and the load of the heat pump system is reduced in an auxiliary condensing manner before the heating pipe is switched off, when the load of the heat pump system is close to the maximum load.

The auxiliary condensing manner is to control air exhausted from the clothes drying drum to be pre-condensed by a water condenser, so as to reduce the temperature of the air entering the heat pump system and reduce the load of the heat pump system.

The auxiliary condensing manner is to assist heat dissipation of the condenser of the heat pump system via an auxiliary fan, so as to reduce the temperature of the condenser and reduce the load of the heat pump system.

The auxiliary condensing manner is to control air exhausted from the clothes drying drum to be pre-condensed by an air condenser, so as to reduce the temperature of the air entering the heat pump system and reduce the load of the heat pump system; preferably, an auxiliary fan is arranged on the air condenser.

When the temperature of the condenser of the heat pump system reaches a maximum value $T_1$, the heat pump system reaches the maximum load; and when the temperature of the condenser is up to $T_1$-$\Delta T$, the heat pump system is close to the maximum load.

The temperature of the condenser is detected. When the temperature of the condenser is higher than $T_1$-$\Delta T$, the water condenser is turned on to pre-condense the air exhausted from the clothes drying drum, or the auxiliary fan is turned on to assist heat dissipation of the condenser of the heat pump system, or the air condenser is turned on to pre-condense the air exhausted from the clothes drying drum.

When the temperature of the air entering the clothes drying drum is up to a set temperature $T_2$, the electrical heating pipe is turned off, and when the temperature of the air entering the clothes drying drum is dropped to a set temperature $T_3$, the electrical heating pipe is turned on once again, wherein $T_2$ is higher than $T_3$.

The heat pump system and the electrical heating system are controlled to work cooperatively, thus allowing the clothes dryer to also comprise an energy-saving mode, in which the electrical heating pipe is turned off, and the air about to enter the clothes drying drum is only heated by the condenser of the heat pump system;

and a general mode, in which the electrical heating pipe is turned on, the air about to enter the clothes drying drum is firstly heated by the condenser of the heat pump system and further heated by the electrical heating pipe, the electrical heating pipe is turned off when the load of the heat pump system reaches the maximum load or the temperature of the heat pump system reaches the preset temperature, and thus the air entering the clothes drying drum is only heated by the condenser of the heat pump system.

In the energy-saving mode and the general mode, the temperature of the condenser is detected, and when the temperature of the condenser reaches the maximum value $T_1$, the load of the heat pump system is reduced in the auxiliary condensing manner.

A highest operating frequency of the compressor in the fast mode is higher than or equal to that of the compressor in the general mode, and a lowest operating frequency of the compressor in the fast mode is higher than or equal to that of the compressor in the general mode. The highest operating frequency of the compressor in the general mode is higher than or equal to that of the compressor in the energy-saving mode, and the lowest operating frequency of the compressor in the general mode is higher than or equal to that of the compressor in the energy-saving mode.

A clothes dryer under the control of the abovementioned control method comprises a clothes drying drum, a heat pump system and an electrical heating system, wherein the heat pump system comprises a compressor, a condenser, an evaporator and a throttling device, and the electrical heating system is an electrical heating pipe. The clothes dryer also comprises a water condenser and/or an air condenser and/or an auxiliary fan, wherein the water condenser and/or the air condenser is arranged between an air outlet of the clothes drying drum and an air inlet of the evaporator, and the auxiliary fan is arranged on the condenser.

By using the technical scheme of the method and the clothes dryer provided by the present disclosure, following beneficial effects are achieved:

the electrical heating system and the heat pump system perform heating simultaneously, and when the load of the heat pump system is close to the maximum load, the load of the heat pump system is reduced in the auxiliary condensing manner, so that the load of the heat pump system is reduced without changing the compressor frequency, the electrical heating pipe is prevented from stopping working, the clothes drying speed is improved, and the clothes drying time is reduced. A plurality of modes is set, and a user can select the clothes drying modes according to needs; the user can select the fast mode to dry the clothes rapidly when in a hurry, also can select the energy-saving mode to reduce energy consumption at ordinary times, and also can select the general mode to reasonably utilize the clothes drying speed and consume energy, and thus energy utilization is maximized.

In the following, the present disclosure is further specifically described through combining with the drawings.

Figure 1:
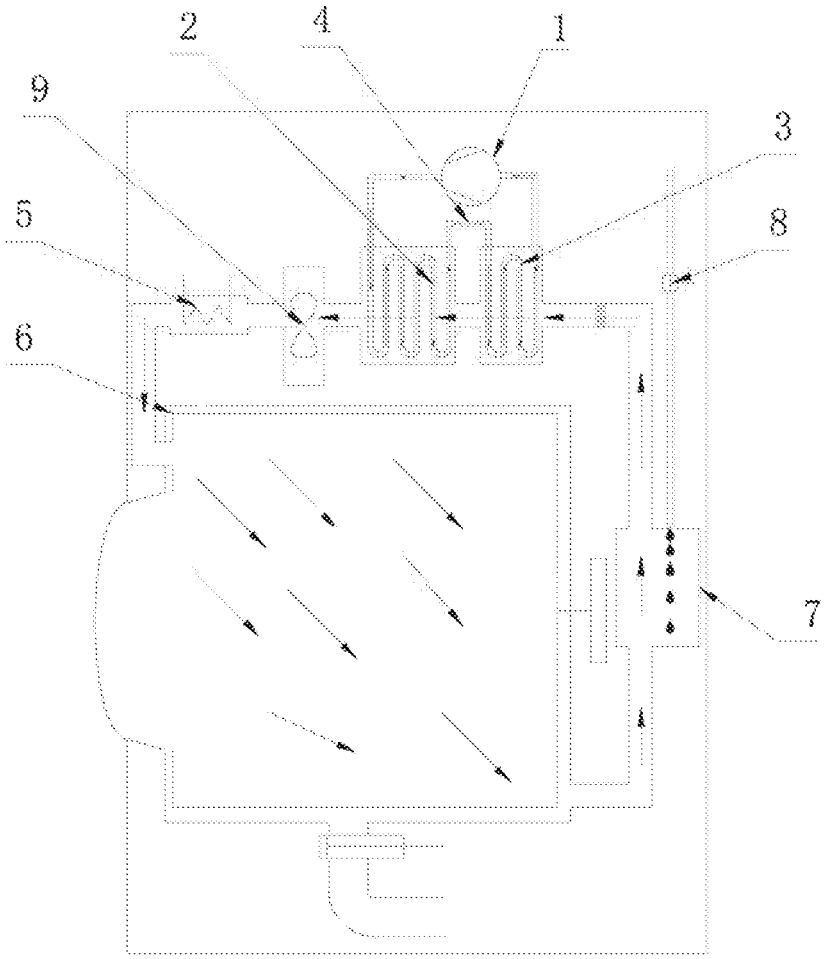
FIG. 1 is a structural diagram of a clothes dryer provided by the present disclosure.

Reference signs in the drawings: 1, compressor; 2, condenser; 3, evaporator; 4, throttling device; 5, electrical heating pipe; 6, clothes drying drum; 7, water condenser; 8, water valve; 9, fan; 10, auxiliary fan; 11, air condenser.

DETAILED DESCRIPTION

Embodiment 1

As shown in the FIG. 1, a clothes dryer provided by the present disclosure comprises a clothes drying drum 6, a heat pump system and an electrical heating system, wherein the heat pump system comprises a compressor 1, a condenser 2, an evaporator 3 and a throttling device 4, and the electrical healing system is an electrical heating pipe 5. The clothes dryer also comprises a water condenser 7 arranged between an air outlet of the clothes drying drum 6 and an air inlet of the evaporator. The condenser 2 of the heat pump system and the electrical heating pipe 5 perform heating simultaneously, so that the temperature of air entering the drum is increased; the water condenser 7 can improve the condensing speed and thus the drying speed is improved. A water valve 8 is arranged on the water condenser 7, and thus turning-on or turning-off of the water condenser 7 is controlled by opening or closing the water valve 8, It is commonly accepted that the clothes drying speed will be improved and the clothes drying time will be reduced by adding the electrical heating pipe 5 for auxiliary heating. However, actually, the clothes drying time is reduced to some extent after the electrical heating pipe 5 is added. But the reduced time is limited within a time range only from the time when the compressor is just turned on for drying until the time when the load of the heat pump system reaches the maximum load. The electrical heating pipe has to stop heating to reduce the load of the heat pump system, when the load of the heat pump system reaches the highest value. After the electrical heating pipe stops heating, the drying speed of the dryer is the same as that in the mode which does not use the electrical heating pipe. If a variable-frequency compressor is used, although the load of the heat pump system can be reduced by reducing the operating frequency of the compressor by making use of frequency regulation of the compressor, the vapour condensing speed is reduced due to reduction of the operating frequency of the compressor, and the drying speed is also affected. In a word, the drying time is not reduced too much by merely adding the electrical heating pipe 5, when a refrigerating system is not improved. Therefore, it does not work as people expect that the clothes drying speed can be greatly improved by adding the electrical heating pipe 5. In the clothes dryer provided by the present disclosure, the water condenser 7 is arranged at the air outlet of the clothes drying drum, so that the water condensing efficiency is high, the temperature of the air exhausted from the clothes drying drum can be reduced rapidly, the temperature of the air entering the evaporator 3 and the condenser 2 can be reduced. Thus the load of the heat pump system is reduced without changing the compressor frequency, the electrical heating pipe 5 is prevented from stopping working, the clothes drying speed is improved, and the clothes drying time is reduced.

Figure 2:
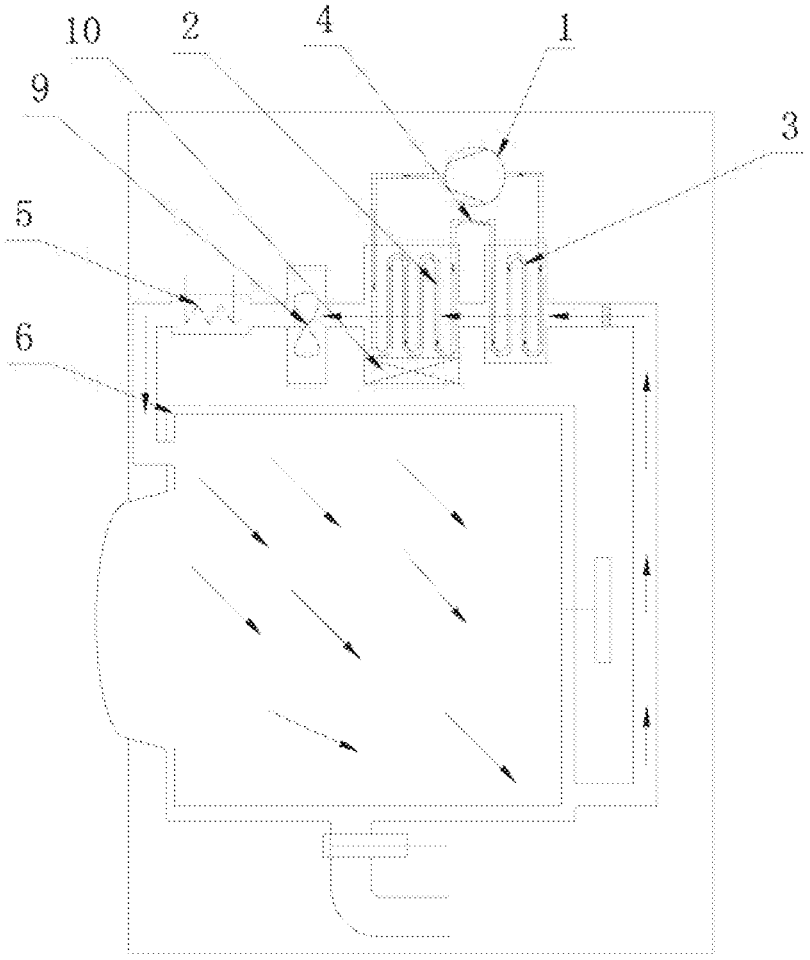
FIG. 2 is a structural diagram of a clothes dryer in the other embodiment of the present disclosure.

Or as shown in the FIG. 2, a clothes dryer provided by the present disclosure comprises a clothes drying drum 6, a heat pump system and an electrical heating system, wherein the heat pump system comprises a compressor 1, a condenser 2, an evaporator 3 and a throttling device 4, and the electrical healing system is an electrical heating pipe 5. The clothes dryer also comprises an auxiliary fan 10 arranged on the condenser 2. Heat dissipation of the condenser 2 can be accelerated, and thus the temperature of the condenser can be reduced. The load of the heat pump system is reduced without changing the compressor frequency, the electrical heating pipe is prevented from stopping working, the clothes drying speed is improved, and the clothes drying time is reduced.

Embodiment 2

The present disclosure discloses a control method for a clothes dryer comprising a clothes drying drum 6, a heat pump system and an electrical heating system, wherein the heat pump system comprises a compressor, a condenser 2, an evaporator 3 and a throttling device 4, and the electrical heating system is an electrical heating pipe 5. The condenser 2 and the electrical heating system 5 are controlled to work cooperatively, thus allowing the clothes dryer to comprise the following modes:

A fast mode, in which when clothes are drying, the electrical heating pipe 5 is turned on; air about to enter the clothes drying drum 6 is controlled to be firstly heated by the condenser 2 of the heat pump system and further heated by the electrical heating pipe 5, and then to enter the clothes drying drum 6; and the load of the heat pump system is reduced in an auxiliary condensing manner before the heating pipe is switched off, when the load of the heat pump system is close to the maximum value. The auxiliary condensing manner is to control air exhausted from the clothes drying drum 6 to be pre-condensed by a water condenser 7, so as to reduce the temperature of the air entering the heat pump system and reduce the load of the heat pump system.

under the fast mode, the air entering the clothes drying drum 6 is simultaneously heated by the condenser 2 and the electrical heating pipe 5, and the temperature of the air entering the drum is high, so that the clothes drying speed is fast. Meanwhile, the air exhausted from the clothes drying drum 6 is pre-condensed by the water condenser 7, so that the temperature of the air entering the heat pump system is reduced, the load of the heat pump system can be prevented from reaching the maximum load. Meanwhile, the condition that the electrical heating pipe 5 is always turned on for heating the air can be ensured, and the high temperature of the air entering the clothes drying drum is continuously maintained, so that the clothes drying speed is improved. And the situation that the clothes drying speed cannot be improved as the working efficiency is reduced due to the fact that the electrical heating pipe is turned off or the frequency of the compressor is reduced to reduce the load of the heat pump system, after the load of the heat pump system reaches the maximum load, is avoided.

An energy-saving mode, in which the electrical heating pipe 5 is turned off, the air entering the clothes drying drum 6 is only heated by the condenser 2 of the heat pump system. Only the heat pump system is used for heating, so that electricity consumption can be avoided when the electrical heating pipe 5 is heating.

A general mode, in which the electrical heating pipe 5 is turned on, the air entering the clothes drying drum 6 is firstly heated by the condenser 2 of the heat pump system and further heated by the electrical heating pipe, and the electrical heating pipe is turned off after the load of the heat pump system reaches the maximum load. And thus the air entering the clothes drying drum is only heated by the condenser of the heat pump system. In an initial drying period, the electrical heating pipe 5 and the condenser 2 perform heating simultaneously, so that the temperature rising speed is improved, the temperature of the air entering the drum is improved, and the clothes drying speed is improved. When the load of the heat pump system reaches the maximum load or the temperature of the heat pump system reaches the preset temperature, the electrical heating pipe is turned off, only the heat pump system is used for heating, and thus electricity consumption can be avoided when the electrical heating pipe 5 is heating. In such a mode, the balance of the clothes drying speed and the energy consumption can be achieved.

A plurality of modes is set, and a user can select the clothes drying modes according to needs. The user can select the fast mode to dry the clothes rapidly when in a hurry, also can select the energy-saving mode to reduce energy consumption at ordinary times, and also can select the general mode to reasonably utilize the clothes drying speed and consume energy, and thus energy utilization is maximized.

When the temperature of the condenser of the heat pump system reaches the maximum value $T_1$, the load of the heat pump system reaches the maximum load. The temperature of the condenser is up to $T_1$-$\Delta T$, when the load of the heat pump system is close to the maximum load. The temperature of the condenser is detected, and when the temperature of the condenser exceeds $T_1$-$\Delta T$, the water condenser is turned on to pre-condense the air exhausted from the clothes drying drum.

The water condenser 7 can also be turned on to pre-condense the air exhausted from the clothes drying drum 6 while the electrical heating pipe 5 is turned on, the air exhausted from the clothes drying drum can be pre-condensed at the beginning, and thus the condensing speed is improved. When the electrical heating pipe 5 and the condenser 2 perform heating simultaneously, the load of the heat pump system can be prevented from reaching the maximum load, so that the electrical heating pipe 5 does not stop working, the temperature of the air entering the clothes drying drum is high, and thus the drying efficiency is high. Or the maximum load reaching time of the heat pump system is prolonged, the frequency of stopping working of the electrical heating pipe 5 is reduced, the air entering the clothes drying drum in a clothes drying period has a high average temperature, and thus the drying efficiency is high.

When the temperature of the air entering the clothes drying drum is up to the set temperature $T_2$, the electrical heating pipe 5 is turned off. And when the temperature of the air entering the clothes drying drum is dropped to the set temperature $T_3$, the electrical heating pipe 5 is turned on once again, wherein $T_2>T_3$. If the temperature of the air entering the clothes drying drum is too high, the clothes may be damaged, so that the temperature of the air entering the clothes drying drum 6 should be controlled to be not higher than the pre-set value $T_2$ which generally is 110~130° C. After the electrical heating pipe 5 is turned off, the temperature of the air will drop when the circulated air enters the clothes drying drum. The electrical heating pipe needs to be turned on once again to increase the temperature of the air entering the drum, when the temperature is dropped to the set temperature $T_3$ which generally is 90-110° C. When the temperature of the air entering the drum is about 100° C., the clothes drying speed of the air is the highest.

In the energy-saving mode and the general mode, the load of the heat pump system can also be reduced in the auxiliary condensing manner which is to control the air exhausted from the clothes drying drum 6 to be pre-condensed by the water condenser 7, so as to reduce the temperature of the air entering the heat pump system and reduce the load of the heat pump system. By detecting the temperature of the condenser 2, when the temperature of the condenser 2 reaches the maximum value $T_1$, the air exhausted from the clothes drying drum is pre-condensed by the water condenser 7, so as to reduce the temperature of the air entering the condenser 2.

Specifically, in the fast mode, the electrical heating pipe 5 works in the initial drying period, and the electrical heating pipe 5 is turned on after the heat pump system is turned on and operated stably. The electrical heating pipe 5 and the condenser 2 of the heat pump system are simultaneously used for heating the air about to enter the clothes drying drum 6 from the initial period to as much time as possible. For example, when the condenser 2 reaches 30° C., the air is also heated to be close to 30° C. after passing through the condenser 2, and further heated to 70° C. by the electrical heating pipe. When the condenser reaches 70° C., the air is also heated to be close to 70° C. after passing through the condenser 2, and further heated to 110° C. by the electrical heating pipe 5. Therefore, the temperature of the air entering the clothes drying drum 6 is far higher than that of the air only heated by the heat pump system. High temperature has a good clothes drying effect, after the condenser 2 reaches the highest load of 70° C., the electrical heating pipe is not turned off, If the temperature of the condenser 2 exceeds the maximum load, a water valve 8 of the water condenser 7 is opened, and the air is pre-condensed by using running water or water in a water tank before entering the evaporator 3 and the condenser 2, so that the temperature of the air entering the evaporator 3 is reduced, the load of the heat pump system is reduced, and meanwhile a pre-condensing function is achieved and the condensing speed of vapour in hot and humid air is improved. The water valve 8 is continuously opened.

When the temperature of the condenser 2 exceeds 70° C. or the set temperature, or the temperature of the air entering the drum exceeds the set temperature of 120° C., the load of the heat pump system is regulated by turning off the electrical heating pipe.

In order to improve the condensing speed, the water valve 8 of the water condenser 7 can be opened once the electrical heating pipe 5 is turned on. By reducing the temperature of the air entering the heat pump system and pre-condensing the air, the condensing speed is improved, and the maximum load reaching time of the heat pump system is prolonged.

In the energy-saving mode, the electrical heating pipe 5 is not turned on, the air is only heated by the condenser 2 of the compressor, and the highest temperature of the air is about 70° C. Along with temperature rising in the clothes drying drum 6, when the condensing temperature of the heat pump system reaches 70° C., the load needs to be reduced, and otherwise the load may exceed the tolerance range of the compressor. For the time being, the water valve 8 of the water condenser 7 is opened, and the air is pre-condensed by using the running water or the water in the water tank before entering the evaporator 3 and the condenser 2, so that the temperature of the air entering the evaporator 3 is reduced, and the load of the heat pump system is reduced. When the condensing temperature of the compressor is reduced to 67° C. or the set temperature, the water valve is closed. Hereby, the load of the heat pump system is regulated.

In the general mode, the electrical heating pipe 5 works in the initial drying period, and the electrical heating pipe 5 is turned on after the heat pump system is turned on and operated stably. In the initial period, the electrical heating pipe 5 and the condenser 2 of the compressor are simultaneously used for heating the air. For example, when the condenser reaches 30° C., the air is also heated to be close to 30° C. after passing through the condenser 2, and further heated to 70° C. by the electrical heating pipe 5, and thus the temperature rising speed of the air entering the clothes drying drum 6 is far higher than the heating speed realized by only using the condenser 2 of the heat pump system. After the condenser 2 reaches the maximum load of 70° C., the electrical heating pipe 5 is turned off, and only the evaporator 3 and the condenser 2 of the heat pump system are used for condensing and heating. Afterwards, if the temperature of the condenser 2 exceeds the tolerance, range of the compressor once again, the water valve 8 of the water condenser 7 is opened, the air is pre-condensed by using the running water or the water in the water tank before entering the evaporator 3 and the condenser 2, so that the temperature of the air entering the evaporator 3 is reduced, and the load of the heat pump system is reduced. When the condensing temperature of the compressor is reduced to 67° C. or the set temperature, the water valve 8 is closed. Hereby, the load of the heat pump system is regulated.

The highest operating frequency of the compressor in the fast mode is higher than or equal to that of the compressor in the general mode, and the lowest operating frequency of the compressor in the fast mode is higher than or equal to that of the compressor in the general mode. The highest operating frequency of the compressor in the general mode is higher than or equal to that of the compressor in the energy-saving mode, and the lowest operating frequency of the compressor in the general mode is higher than or equal to that of the compressor in the energy-saving mode. The frequency of the compressor 1 is high, so that the working efficiency is high, and the clothes drying speed may also be improved.

Embodiment 3

As shown in the FIG. 2, a clothes dryer in the present embodiment comprises an auxiliary tan 10. The auxiliary condensing manner is to assist heat dissipation of a condenser 2 of a heat pump system via the auxiliary fan 10, so as to reduce the temperature of the condenser and reduce the load of the heat pump system. The other methods are all the same as those in the embodiment 2.

Embodiment 4

Figure 3:
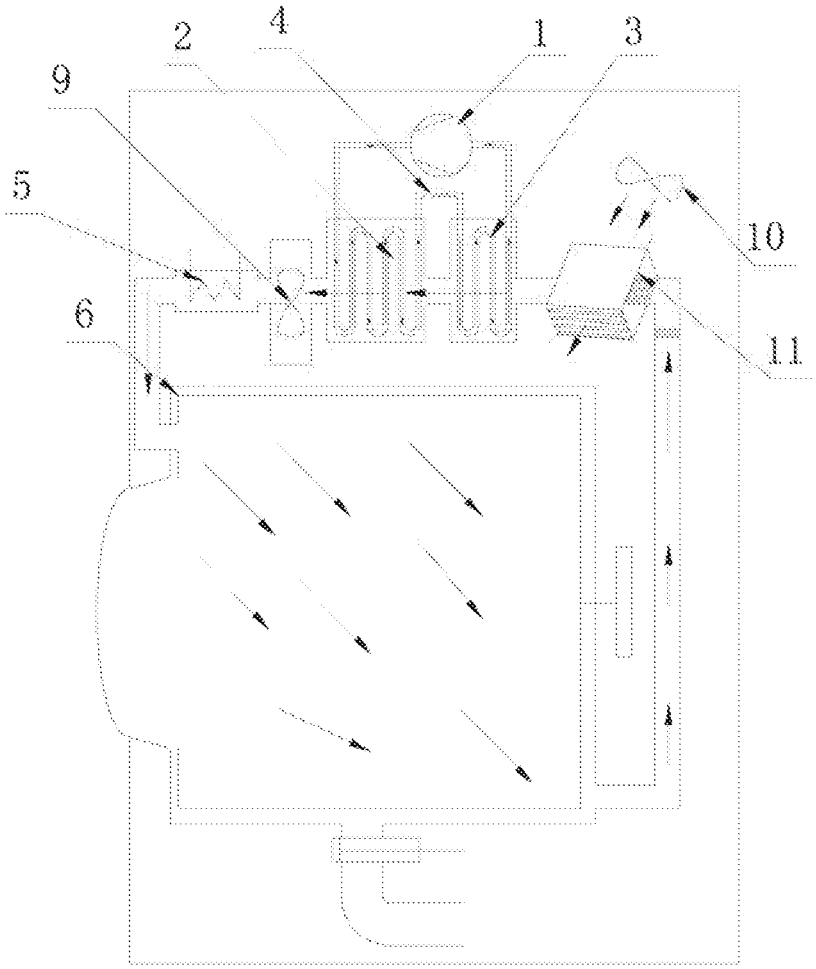
FIG. 3 is a structural diagram of a clothes dryer in another embodiment of the present disclosure.

As shown in the FIG. 3, a clothes dryer in the present embodiment comprises an air condenser 11. The auxiliary condensing mode is to pre-condense the air exhausted from clothes drying drum via the air condenser 11, so as to reduce the temperature of the air entering a heat pump system and reduce the load of the heat pump system. The other methods are all the same as those in the embodiment 2.

An auxiliary fan can also be arranged on the air condenser 11 to prompt air movement and assist heat dissipation.

The abovementioned merely are embodiments of the present disclosure, it should be understood that some modifications or improvements without departing from the principles of the present disclosure are apparent to those ordinarily skilled in the art, and should be considered as falling within the scope of the present disclosure.

The invention claimed is:

1. A control method for a clothes dryer that comprises a clothes drying drum, a heat pump system and an electrical heating system, the heat pump system comprises a compressor, a condenser, an evaporator and a throttling device, and the electrical heating system is an electrical heating pipe, comprising controlling the heat pump system and the electrical heating system to work cooperatively, thus allowing the clothes dryer to at least comprise a fast mode in which the electrical heating pipe is turned on after the compressor is turned on and operated;

air about to enter the clothes drying drum is controlled to be firstly heated by the condenser of the heat pump system and further heated by the electrical heating pipe, and then to enter the clothes drying drum; and a load of the heat pump system is reduced in an auxiliary condensing manner before the heating pipe is switched off, when the load of the heat pump system is close to a maximum load.

2. The control method for the clothes dryer according to claim 1, wherein the auxiliary condensing manner is to control air exhausted from the clothes drying drum to be pre-condensed by a water condenser, so as to reduce a temperature of the air entering the heat pump system and reduce the load of the heat pump system.

3. The control method for the clothes dryer according to claim 1, wherein the auxiliary condensing manner is to assist heat dissipation of the condenser of the heat pump system via an auxiliary fan, so as to reduce a temperature of the condenser and reduce the load of the heat pump system.

4. The control method for the clothes dryer according to claim 1, wherein the auxiliary condensing manner is to control air exhausted from the clothes drying drum to be pre-condensed by an air condenser, so as to reduce a temperature of the air entering the heat pump system and reduce the load of the heat pump system.

5. The control method for the clothes dryer according to claim 1, wherein when the temperature of the condenser of the heat pump system reaches a maximum value $T_1$, the load of the heat pump system reaches the maximum load; and when the temperature of the condenser is up to $T_1-\Delta T$, the load of the heat pump system is close to the maximum load.

6. The control method for the clothes dryer according to claim 5, wherein detecting the temperature of the condenser, when the temperature of the condenser exceeds $T_1-\Delta T$, turning on the water condenser to pre-condense the air exhausted from the clothes drying drum, or turning on an auxiliary fan to assist heat dissipation of the condenser of the heat pump system, or turning on the air condenser to pre-condense the air exhausted from the clothes drying drum.

7. The control method for the clothes dryer according to claim 1, wherein when the temperature of the air entering the clothes drying drum is up to a set temperature $T_2$, turning off the electrical heating pipe, and when the temperature of the air entering the clothes drying drum is reduced to a set temperature $T_3$, turning on the electrical heating pipe again, wherein $T_2>T_3$.

8. The control method for the clothes dryer according to claim 1, wherein controlling the heat pump system and the electrical heating system to work cooperatively, thus allowing the clothes dryer to also comprise:

an energy-saving mode, in which the electrical heating pipe is turned off, and the air about to enter the clothes drying drum is only heated by the condenser of the heat pump system;

and a general mode, in which the electrical heating pipe is turned on, the air about to enter the clothes drying drum is firstly heated by the condenser of the heat pump system and further heated by the electrical heating pipe, the electrical heating pipe is turned off when the load of the heat pump system reaches the maximum load or a temperature of the heat pump system reaches a pre-set temperature, and thus the air entering the clothes drying drum is only heated by the condenser of the heat pump system.

9. The control method for the clothes dryer according to claim 8, wherein detecting the temperature of the condenser in the energy-saving mode and the general mode, and when the temperature of the condenser reaches the maximum value $T_1$, reducing the load of the heat pump system in the auxiliary condensing manner.

10. The control method for the clothes dryer according to claim 8, wherein a highest operating frequency of the compressor in the fast mode is higher than or equal to that of the compressor in the general mode, and a lowest operating frequency of the compressor in the fast mode is higher than or equal to that of the compressor in the general mode;

a highest operating frequency of the compressor in the general mode is higher than or equal to that of the compressor in the energy-saving mode, and a lowest operating frequency of the compressor in the general mode is higher than or equal to that of the compressor in the energy-saving mode.

11. A clothes dryer under the control of the control method according to claim 1 comprising, a clothes drying drum, a heat pump system and an electrical heating system, wherein the heat pump system comprises a compressor, a condenser, an evaporator and a throttling device, and the electrical heating system is an electrical heating pipe, characterized in that the clothes dryer also comprises at least one of a water condenser and an air condenser and an auxiliary fan, wherein at least one of the water condenser and the air condenser is arranged between an air outlet of the clothes drying drum and an air inlet of the evaporator, and the auxiliary fan is arranged on the condenser.

12. The control method for the clothes dryer according to claim 2, wherein when the temperature of the condenser of the heat pump system reaches a maximum value $T_1$, the load of the heat pump system reaches the maximum load; and when the temperature of the condenser is up to $T_1-\Delta T$, the load of the heat pump system is close to the maximum load.

13. The control method for the clothes dryer according to claim 3, wherein when the temperature of the condenser of the heat pump system reaches a maximum value $T_1$, the load of the heat pump system reaches the maximum load; and when the temperature of the condenser is up to $T_1-\Delta T$, the load of the heat pump system is close to the maximum load.

14. The control method for the clothes dryer according to claim 4, wherein when the temperature of the condenser of the heat pump system reaches a maximum value $T_1$, the load of the heat pump system reaches the maximum load; and when the temperature of the condenser is up to $T_1-\Delta T$, the load of the heat pump system is close to the maximum load.

15. The control method for the clothes dryer according to claim 2, wherein when the temperature of the air entering the clothes drying drum is up to a set temperature $T_2$, turning off the electrical heating pipe, and when the temperature of the air entering the clothes drying drum is reduced to a set temperature $T_3$, turning on the electrical heating pipe again, wherein $T_2>T_3$.

16. The control method for the clothes dryer according to claim 3, wherein when the temperature of the air entering the clothes drying drum is up to a set temperature $T_2$, turning off the electrical heating pipe, and when the temperature of the air entering the clothes drying drum is reduced to a set temperature $T_3$, turning on the electrical heating pipe again, wherein $T_2>T_3$.

17. The control method for the clothes dryer according to claim 4, wherein when the temperature of the air entering the clothes drying drum is up to a set temperature $T_2$, turning off the electrical heating pipe, and when the temperature of the air entering the clothes drying drum is reduced to a set temperature $T_3$, turning on the electrical heating pipe again, wherein $T_2>T_3$.

18. The control method for the clothes dryer according to claim 5, wherein when the temperature of the air entering the clothes drying drum is up to a set temperature $T_2$, turning off the electrical heating pipe, and when the temperature of the air entering the clothes drying drum is reduced to a set temperature $T_3$, turning on the electrical heating pipe again, wherein $T_2>T_3$.

19. The control method for the clothes dryer according to claim 6, wherein when the temperature of the air entering the clothes drying drum is up to a set temperature $T_2$, turning off the electrical heating pipe, and when the temperature of the air entering the clothes drying drum is reduced to a set temperature $T_3$, turning on the electrical heating pipe again, wherein $T_2>T_3$.

20. The control method for the clothes dryer according to claim 4, wherein an auxiliary fan is arranged on the air condenser.

* * * * *